United States Patent [19]

Reponty

[11] Patent Number: 5,065,993

[45] Date of Patent: Nov. 19, 1991

[54] ACCUMULATOR CYLINDER ASSEMBLY FOR A FOLDING MACHINE OF A PRINTING PRESS

[75] Inventor: André Reponty, Gouvieux, France

[73] Assignee: Heidelberger Druckmaschinen AG, Heidelberg, Fed. Rep. of Germany

[21] Appl. No.: 629,400

[22] Filed: Dec. 18, 1990

[30] Foreign Application Priority Data

Dec. 18, 1989 [FR] France ..... 89 16709

[51] Int. Cl.[5] ..... B42C 1/00

[52] U.S. Cl. ..... 270/49; 270/50; 270/47; 493/424

[58] Field of Search ..... 270/4, 6, 7, 12-15, 270/45-50; 493/424, 425, 426, 428, 429, 432, 416, 454

[56] References Cited

U.S. PATENT DOCUMENTS

| | | | |
|---|---|---|---|
| 2,016,486 | 10/1935 | Crafts | 270/50 |
| 4,190,242 | 2/1980 | Bolza-Schunemann | 270/50 |
| 4,437,855 | 3/1984 | Bullen | 270/50 |
| 4,892,036 | 1/1990 | Lange . | |

FOREIGN PATENT DOCUMENTS

| | | | |
|---|---|---|---|
| 1810294 | 10/1969 | Fed. Rep. of Germany . | |
| 93771 | 7/1980 | Japan | 270/47 |
| 372609 | 5/1932 | United Kingdom | 270/50 |

*Primary Examiner*—Edward K. Look
*Assistant Examiner*—Therese M. Newholm
*Attorney, Agent, or Firm*—Herbert L. Lerner; Laurence A. Greenberg

[57] ABSTRACT

Accoumulator cylinder assembly for a folding machine of a printing press having tucking blades mounted on respective tucking-blade shafts and respectively associated with entrainer members mounted on entrainer shafts includes, for each entrainer shaft and each tucking-blade shaft, a latch fixed to the accumulator cylinder and having an operating position in which the latch blocks the shaft to prevent an roller thereof from being affected by a respective control region of a respective cam thereof and a non-operating position in which the latch does not act on the shaft; a latch-signal production device for generating at least one series of periodic signals according to an angular position of the accumulator cylinder, in order to cause it to operate in an accumulation mode; a device for enabling the latches to respond to the signals wherein each latch the operating position thereof when a signal is addressed to it, and the non-operating position thereof when no signal is addressed to it; and a device for selecting the operating mode of the cylinder wherein corresponding signals are fed to the latches.

20 Claims, 7 Drawing Sheets

ACCUMULATOR CYLINDER ASSEMBLY FOR A FOLDING MACHINE OF A PRINTING PRESS

The invention relates to an accumulator cylinder assembly and, more particularly, to an accumulator cylinder assembly for a folding machine of a printing machine.

A folding machine or folder operates on a continuous paper web, for example, which is usually double printed, i.e. by a printing plate having two halves respectively producing a copy or signature on the paper, usually called an A copy or signature and a B copy or signature, each printed in a half-rotation of a printing cylinder which is covered by the printing plate, the thus printed paper web carrying a regular succession of the A and B copies or signatures. The paper web is sometimes triple printed, i.e., with a regular succession of A, B and C copies or signatures.

Accumulator cylinders usually have a circumference which is large enough to accommodate or carry three copies. Along respective generatrices of the cylindrical surface of the cylinders, the latter are provided with three uniformly distributed cutting countermembers, three entrainer members disposed immediately behind each cutting countermember, and three tucking-blades disposed half-way between two cutting countermembers. Other accumulator cylinders are known which are capable of carrying two, four, five and even seven copies.

On its upstream side, the accumulator cylinder cooperates with a cutter cylinder fitted with serrated cutter blades. The cutter cylinder is so disposed relative to the accumulator cylinder that serrated cutter blades enter the cutting countermembers in order to cut the paper web which is simultaneously held on the accumulator cylinder by the entrainer member. A cutting occurs each time the web has moved forward a distance equal to the length of one copy or signature, the web being disposed so that it is cut at dividing lines between copies or signatures.

On its downstream side of the accumulator cylinder, a tucking blade cooperates with a cylinder having folding jaws which are regularly spaced along a generatrix of the outer cylindrical surface thereof. The folding jaw cylinder is so disposed relative to the accumulator cylinder that each time a jaw is tangential to the accumulator cylinder it is aligned with a tucking blade.

When the tucking blade facing a jaw is deployed or driven out, the paper which covers it is gripped by the jaw, an entrainer device which precedes the tucking blade is released, and the paper is transferred to the folder jaws and a fold is formed simultaneously.

Depending upon the requirements, the accumulator cylinder may be operated in multiple (double or triple) production mode or in accumulation mode.

In the multiple production mode, each tucking blade is deployed or driven out whenever it is aligned with or located opposite a jaw so that each copy is transferred independently and by itself to the folder jaw cylinder. This mode of production is usually employed when the A and B or the A, B and C copies or signatures are identical.

In the accumulation mode, in the case of double printing and for an accumulator cylinder which can carry three copies or signatures, each tucking blade is deployed alternatingly only one time in two when it is aligned with a jaw. When the tucking blade is not deployed, the copy or signature which covers it remains on the accumulator cylinder and is covered on the next rotation by a second copy or signature and, when the tucking blade is then deployed, the set of two copies is transferred to the jaw cylinder, each set including an A copy or signature and a B copy or signature because the copy or signature on the cylinder is covered by the third copy or signature following it.

In a double printing, accumulator cylinders capable of carrying five or even seven copies are sometimes used. The operation is similar but each cop is covered by the fifth or the seventh copy following it.

In the case of triple printing, an accumulator cylinder capable of carrying five copies is generally used but sometimes cylinders capable of carrying two, four or seven copies are used, each tucking blade being deployed only one time in three when aligned with a jaw.

The accumulation mode is generally employed when the A and B or A, B and C copies or signatures are different.

Various devices have become known heretofore for controlling the entrainer members and the tucking blades of the accumulator cylinder, and in particular a device which includes, for each tucking blade, a tucking-blade shaft having an insertion position in which the respective tucking blade is deployed and a retracted position in which the tucking blade is retracted; a fixed tucking blade shaft control cam having a recess or control region on its periphery, each tucking-blade shaft having a lever carrying a roller held elastically against the cam each tucking-blade shaft being in the insertion position when its roller is in the recess or control region and in the retracted position otherwise, the cam being positioned so that its recess or control region faces the roller of the tucking-blade shaft when the tucking blade associated with the shaft is aligned with a jaw of the jaw cylinder; for each entrainer member, an entrainer shaft having am entraining position in which the paper is held on the cylinder, and a release position in which the paper is released; a fixed entraining shaft control cam having a recess or control region on its periphery, each entrainer shaft having a lever carrying a roller held elastically against the cam, each entrainer shaft being in a release position when its roller is in the recess or control region, and in the entraining position otherwise, the cam being positioned so that its recess or control region faces the roller of the entrainer shaft when a tucking blade preceding the entrainer member associated with the entrainer shaft is aligned with a jaw of the jaw cylinder; a sector with the same radius as the circular part of the entrainer shaft cam and a sector with the same radius as the circular part of the tucking-blade shaft cam, each rotating coaxially with the accumulator cylinder, at a speed greater than that of the cylinder and in the same direction, each tucking-blade shaft and entrainer shaft having an auxiliary lever carrying a roller adapted to cooperate with its sector so that if the roller on the auxiliary lever faces the sector at the same time as the roller on the main lever faces the recess or control region on its cam it cannot descend and follows the same path as if there were no recess or control region, each sector subtending an angle so that, as the result of a change in phase, it can assume a neutralized position in which it does not come into contact with the rollers on the auxiliary levers, and an active position in which it comes into contact with these rollers.

In the neutralized position of the sectors, the cooperation between the rollers of the main levers and the respective fixed cams is never interrupted, the cylinder operating in the multiple production mode.

In the active position of the sectors, the cylinder operates in the accumulation mode.

On changing the multiple production mode and the accumulation mode, it is necessary to stop the folding machine and to change the phase relationship of the two sectors, which has the disadvantage of being a time-consuming and relatively complex operation.

It is accordingly an object of the invention to provide an accumulator cylinder assembly having a device for controlling the entrainer members and the tucking blades which makes it easier to change the operating mode.

Another object of the invention is to provide an accumulator cylinder assembly with enhanced operating capabilities.

With the foregoing and other objects in view, there is provided, in accordance with the invention, an accumulator cylinder assembly for a folding machine of a printing press having tucking-blades respectively associated with entrainer members and cutting countermembers, and a device for controlling the tucking-blades and the entrainer members including, for each tucking-blade, a tucking-blade shaft having an insertion position in which the respective tucking-blade is deployed in order to insert paper covering the respective tucking-blade into a jaw of a jaw cylinder cooperating with the accumulator cylinder, and a retracted position in which the tucking-blade is retracted; a fixed tucking-blade shaft control cam having a control region on a periphery thereof, each tucking-blade shaft having a lever carrying a roller resiliently held against the cam, the tucking-blade shaft being in the insertion position when its roller is in the control region, and being in the retracted position when the roller is not in the control region, the cam being disposed so that its control region is located opposite the roller of the tucking-blade shaft when the tucking-blade associated with the shaft is aligned with the respective jaw of the jaw cylinder; for each entrainer member, an entrainer shaft having an entraining position in which the paper is firmly held on the accumulator cylinder, and a release position in which the paper is released; a fixed entrainer shaft control cam having a control region on a periphery thereof, each entrainer shaft having a lever carrying a roller held resiliently against the cam, each entrainer shaft being in a release position when its roller is in the control region of the entrainer shaft control cam and in the entraining position when its roller is not therein, the cam being disposed so that its control region is located opposite the roller of the entrainer shaft when a tucking blade preceding the respective entrainer member associated with the entrainer shaft is located opposite the respective jaw of the jaw cylinder; the control device further comprising: for each entrainer shaft and each tucking-blade shaft, a latch fixed to the accumulator cylinder and having an operating position in which the latch blocks the shaft to prevent its roller from being affected by the respective control region of the respective cam thereof and a non-operating position in which the latch does not act on the shaft; latch-signal production means for generating at least one series of periodic signals according to the angular position of the accumulator cylinder, in order to cause it to operate in an accumulation mode; means for enabling the latches to respond to the signals wherein each latch assumes the operating position thereof when a signal is addressed to it, and the non-operating position thereof when no signal is addressed to it; and means for selecting the operating mode of the cylinder wherein corresponding signals are fed to the latches.

When the latches receive signals, the cylinder operates in the accumulation mode; when they do not receive signals the latches remain non-operating and the cylinder operates in the multiple production mode.

A simple switching operation is therefore sufficient to change from one operating mode to the other and this is readily automated and in any event much simpler than the mechanical operation required by prior art devices.

In accordance with another feature of the invention, the selecting means include an electrical switch disposed between the signal production means and an electrical power supply for supplying power thereto.

When the switch isolates the signal production means from their power supply, they do not produce any signal, and the cylinder operates in the multiple production mode; when the switch enables a supply of power to the signal production means the cylinder operates in the accumulation mode.

In accordance with another feature of the invention, the means for enabling the latches to respond to the signals include a rotary electrical contact having, for each series of signals generated by the signal production means, a ring fastened to the accumulator cylinder and connected to each latch to which the series of signals is addressed, and a fixed brush connected to the signal production means.

In accordance with an added feature of the invention, the accumulator assembly has a hollow central shaft, the interior of which is connected to a pneumatic pressure supply through a rotary seal, each of the latches is a pneumatic latch, and the means for enabling the latches to respond to the signals include at least one solenoid valve secured to the accumulator cylinder, connected electrically to the ring of the rotary contact and connected pneumatically to at least one latch and to the interior of the hollow central shaft, the solenoid valve having means for venting the latch in the absence of any signal and, in the presence of a signal, for connecting the latch to the interior of the hollow shaft.

In accordance with an additional feature of the invention, each of the latches has a movable rod which is deployed in the operating position and retracted in the non-operating position.

In accordance with yet another feature of the invention, each of the entrainer shafts and tucking-blade shafts has a projecting lever extending therefrom and engageable by a respective latch.

In accordance with yet a further feature of the invention, each of the latches is a single-acting actuator spring-loaded into the non-operating position.

In accordance with yet an added feature of the invention, each of the latches is a solenoid valve having a plunger spring-loaded into the non-operating position.

In accordance with yet an additional feature of the invention, each of the latches is mounted on a flange of the accumulator cylinder near the respective shaft associated with each latch.

In an accumulator cylinder in accordance with the invention, instead of having a purely mechanical system which simultaneously blocks the shafts and determines, according to the position of the cylinder, at what instant of time the shafts must be blocked, the latches block the shafts and the signal production means determine when the shafts must be blocked.

An accumulator cylinder in accordance with the invention is therefore capable of operating in any accumulation mode provided that it is known how to produce the corresponding signals.

As will be shown hereinafter, the invention therefore makes it possible to provide accumulator cylinders which implement various types of accumulations and to enhance the operating capabilities of these cylinders.

In accordance with still another feature of the invention, there is provided an odd number of the tucking blades at least equal to three, the control device having means for actuating the accumulator cylinder to operate with double printed paper selectively in a double production mode and in an accumulation-by-twos mode.

In order that the A and B copies, in an accumulation mode, should always be superposed in the same order (for example, B always over A), there are provided in accordance with another feature of the invention, signal production means which are capable of generating a series of signals for respective pairs of latches, the pairs including a first latch associated with a tucking-blade shaft and a second latch associated with an entrainer shaft preceding the tucking-blade shaft, the signals produced being such that paper covering a first tucking-blade is not transferred to the jaw cylinder, and paper covering a second tucking-blade following the first tucking-blade is transferred, and so forth.

In the interest of simplicity, convenience and economy, there are provided, in accordance with a further feature of the invention, signal production means which comprise a sector rotatable at half the speed of the accumulator cylinder, respective fixed sensors for the tucking-blade, the sensors being equi-angularly and regularly distributed opposite a travel path of the sector, and means for generating a series of signals for each of the sensors, a signal being generated when a sensor is disposed opposite the sector and not generated otherwise.

In accordance with still an added feature of the invention, the signal production means further comprise a second fixed sensor for each of the tucking-blades, the second sensor being offset 180° relative to the first-mentioned sensor, and a switch for selecting the signals generated by the first sensors or by the second sensors.

Thus, for the same position of the paper relative to the accumulator cylinder, with one set of sensors, the A copies cover the B copies and, with the other set of sensors, the B copies cover the A copies.

It is therefore seen that, in addition to facilitating changeovers of the operating mode of the accumulator cylinder, the invention has the advantage of increasing its operating capabilities in the accumulation mode.

In accordance with still an additional feature of the invention, the control device is adapted to cause the accumulator cylinder to operate with triple printed paper in a triple production mode or in an accumulation-by-threes mode, the accumulator cylinder having a suitable number of tucking-blades selected from the group consisting of two, four, five and seven tucking-blades.

In order that the A, B and C copies should be always superposed in the same order, when in the accumulation mode of operation, there are provided, in accordance with an added feature of the invention, signal production means which are capable of generating a series of signals for respective pairs of latches comprising a first latch associated with a tucking-blade shaft and a second latch associated with an entrainer shaft preceding the tucking-blade shaft, the signals produced being such that paper covering a first tucking-blade is not transferred to the jaw cylinder, paper covering a second trucking-blade following the first tucking-up blade is not transferred, paper covering a third tucking-blade following the second tucking-blade is transferred, and so forth.

Thus for a cylinder with five tucking blades, if one copy is kept on the cylinder on the next revolution it will be covered by the fifth copy which follows it, so that if the first copy is a B copy it will be covered with an A copy; likewise, if the B and A copies are kept on the cylinder, they will be covered on the next rotation by a C copy.

Also in the interest of simplicity, convenience and economy, there are provided in accordance with an additional feature of the invention, signal production means which comprise a sector rotatable at one-third the speed of the accumulator cylinder; respective pairs of fixed sensors for each tucking-blade, the sensors of each pair being mutually spaced 240° apart the pairs of sensors being equi-angularly and regularly distributed facing a path of the sector; and means for generating a series of signals for each sensor, wherein a signal is generated when a sensor is facing the cylinder and not generated otherwise.

In accordance with another feature of the invention, the control device enables the accumulator cylinder to operate with double printed or triple printed paper selectively in a multiple production mode, in an accumulation-by-twos mode and in an accumulation-by-threes mode, the accumulator cylinder comprising a number of tucking-blades selected from the group consisting of five and seven tucking-blades.

The capabilities of the accumulator cylinder can therefore be further enhanced.

In the accumulation mode, in order for the A and B or A, B and C copies to be always superposed in the same order, there are provided, in accordance with yet another feature of the invention, signal production means which are affective for generating a series of signals for respective pairs of latches, each pair comprising a first latch associated with a tucking-blade shaft and a second latch associated with an entrainer shaft preceding the tucking-blade shaft, and including an accumulation quantity switch having a selected position according to which the signals produced selectively cause paper covering a first tucking-blade not to be transferred to the jaw cylinder, paper covering a second tucking-blade following the first tucking-blade to be transferred, and so forth; and paper covering a first tucking-blade not to be transferred to the jaw cylinder, paper covering a second tucking-blade following the first tucking-blade also not to be transferred, paper covering a third tucking-blade following the second tucking-blade to be transferred, and so forth.

The first position represents accumulation by twos mode, and the second position accumulation by threes mode.

Further in the interest of simplicity, convenience and economy, there are provided in accordance with a further feature of the invention, signal production means which comprise: a first sector rotating at half the speed of the accumulator cylinder and a first fixed sensor for each tucking-blade, the sensors being equi-angularly and regularly facing a path of the first sector; a second sector rotating at one third the speed of the accumulator cylinder and a pair of fixed second sensors for each tucking-blade, the sensors of each pair being spaced apart 240°, the pairs of second sensors being equi-angularly and regularly distributed facing a path of the second sector.

In accordance with a concomitant feature of the invention, there are provided means for generating a series of signals selectively for the first sensors and for the second sensors, respectively, according to the position of the accumulation quantity switch, a signal being generated when a sensor is facing its sector and not generated otherwise.

A force-locking connection is one which connects two elements together by force external to the elements, as opposed to a form-locking connection which is provided by the shapes of the elements themselves.

Other features which are considered as characteristic for the invention are set forth in the appended claims.

Although the invention is illustrated and described herein as embodied in accumulator cylinder assembly for a folding machine of a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
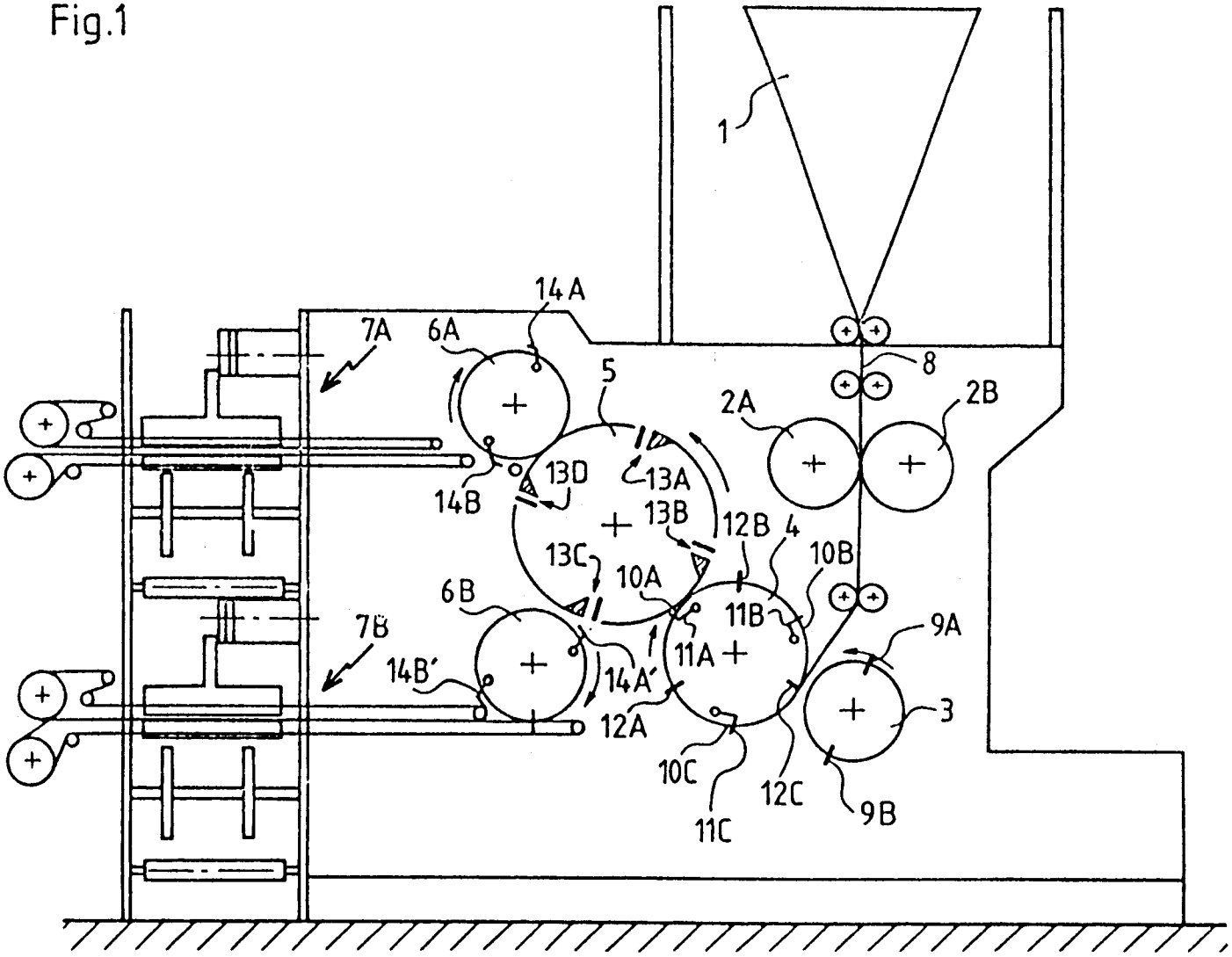
FIG. 1 is a diagrammatic elevational view of a folding machine or folder incorporating an accumulator cylinder in accordance with the invention.

Referring now to the drawing and, first, particularly to FIG. 1 thereof, there is shown therein a folder or folding machine of generating conventional construction but incorporating therein an accumulation cylinder 4 constructed in accordance with the invention. It is constructed to process a paper web printed in double mode carrying a succession of A and B copies.

The folder of FIG. 1 includes, in the order encountered by the paper as it travels therethrough, a triangle or former 1, perforator rollers 2A and 2B, a cutter cylinder 3, the accumulator cylinder 4 in accordance with the invention which cooperates on its upstream side with the cutter cylinder 3, a folder jaw cylinder 5 with which the cylinder 4 cooperates on its downstream side, two slowing or delaying cylinders 6A and 6B respectively cooperating with the cylinder 5 and two former folds 7A and 7B, respectively, located downstream from the delaying cylinder 6A and the delaying cylinder 6B.

The cylinders 3, 4, 5, 6A and 6B rotate in the direction shown by the respective arrows.

The former 1 receives the printed paper web directly from the printing machine and forms a middle longitudinal fold therein.

The perforator rollers 2A and 2B each have the same circumference as the non-illustrated printing cylinder and are provided with means for perforating transversely the web of paper 8 folded by the former 1 at locations of the paper at which the paper will be folded by cooperation of the cylinders 4 and 5 (note hereinbelow).

The cutter cylinder 3 has the same circumference as the printing cylinder and is provided with two serrated cutters 9A and 9B disposed diametrically opposite one another along a generatrix of the outer cylindrical surface of the cylinder 3.

The circumference of the accumulator cylinder 4 is one and a half times that of the printing cylinder. Along respective generatrices thereof, it includes (note also FIGS. 2 and 3) three uniformly distributed cutting countermembers 10A, 10B and 10C, three entrainer members 11A, 11B and 11C, each formed of a row of register pins or dowels 11 disposed immediately after a respective cutting countermember 10A, 10B and 10C, and three tucker or tucking blades 12A, 12B and 12C respectively disposed halfway between each two cutting countermembers 10A, 10B and 10C.

The cylinders 3 and 4 are disposed relative to one another so that the serrated cutters 9A and 9B engage with one of the cutting countermembers 10A, 10B or 10C when they are tangential to the accumulator cylinder 4 in order to cut the paper transversely. The paper is immediately held fast on the cylinder 4 by the entrainer member 11A, 11B, 11C which follows the cutting countermember 10A, 10B, 10C.

Given the diameter and the arrangement of the cutters on the cutting cylinder, a cut is produced each time the paper web has been moved forward a distance corresponding to half the circumference of the printing cylinder, the paper web being disposed so that it is cut at the division between the printed copies.

The jaw cylinder 5 has a circumference which is twice that of the printing cylinder, and has four jaws 13A, 13B, 13C and 13D which are regularly distributed and spaced along a generatrix of the cylinder 5. The cylinders 4 and 5 are disposed relative to one another so that each time a jaw is tangential to the cylinder 4 it is aligned with a tucker or tucking blade.

The slowing cylinders 6A and 6B rotate at the same angular speed as the jaw cylinder 5. They are carriers of tongs or clamp rollers 14A and 14B for the cylinder 6A and carriers of tongs or clamp rollers 14A' and 14B' for the cylinders 6B.

The slowing or delay cylinders 6A and 6B are arranged so that the clamp 14B of the cylinder 6A, in passing, takes up the copy or signature carried by the jaw 13D of the cylinder 5, the clamp 14A of the cylinder 6A takes up the copy or signature carried by the jaw 13B of the cylinder 5, the clamp 14A' of the cylinder 6B takes up the copy or signature carried by the jaw 13C of the cylinder 5, and the clamp 14B' of the cylinder 6B takes up the copy or signature carried by the jaw 13D of the cylinder 5.

Because the diameter of the cylinders 6A and 6B is, moreover, smaller than that of the jaw cylinder 5, and because the three cylinders 6A, 6B and 5 all rotate at the same angular speed, the linear speed of the slowing cylinders 6A and 6B is less than that of the folding jaw cylinder 5.

The accumulator cylinder 4 is shown in greater detail in FIGS. 2 through 6. It has a central shaft 15 rotatably mounted in bearings 16A and 16B form-lockingly fastened to a frame 17 of the folding machine, two circular flanges 18A and 18B welded to the shaft 15 and spaced from one another a distance substantially equal to the width of the folded travelling web 8, and a plate 19 welded to the flanges 18A and 18B and forming a side wall of the cylinder 4.

Figure 3:
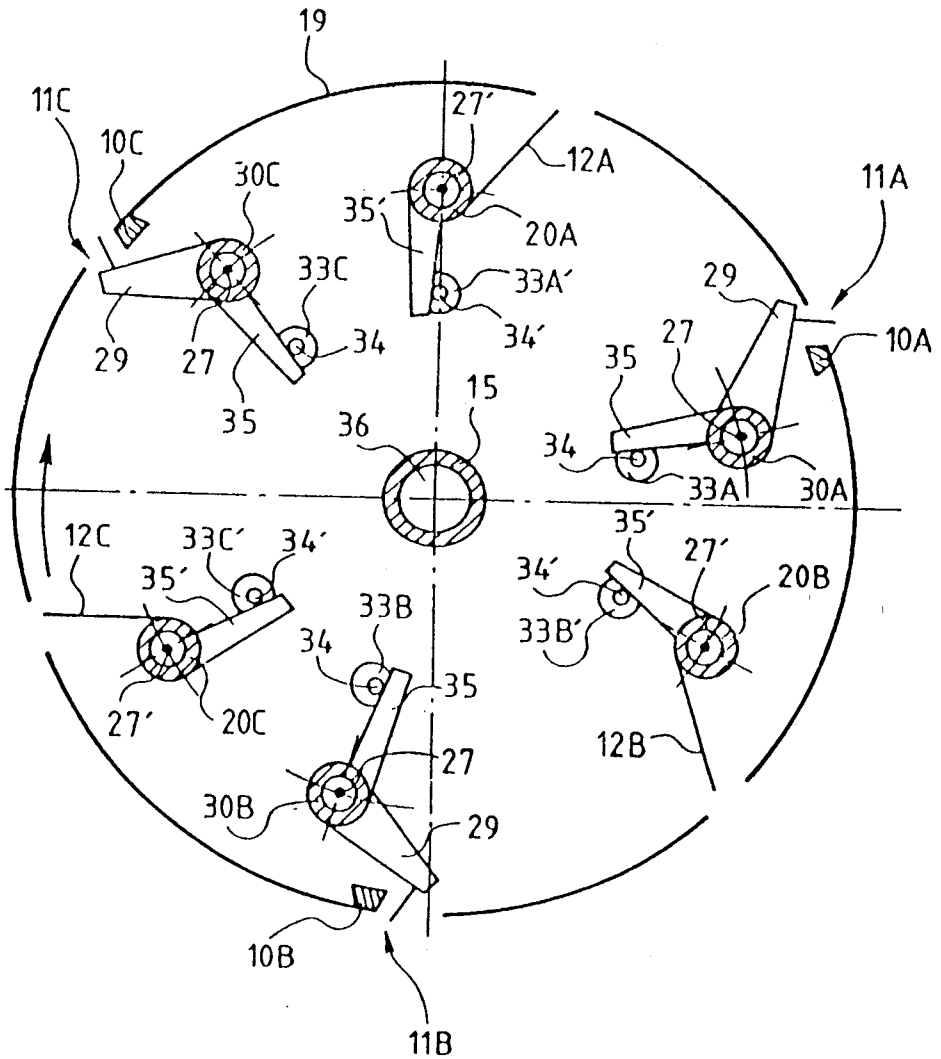
FIG. 3 is a somewhat enlarged diagrammatic cross-sectional view of the accumulator cylinder of FIG. 2 taken in the direction of the arrows on a plane in which the section line II—II is disposed.

The register pins 11 are carried by levers 29, and the set of levers of each of the entrainer members 11A, 11B, 11C is carried by respective shafts 30A, 30B and 30C, which are rotatably mounted on the flanges 18A and 18B near the plate 19 in respective bearings 21A and 21B. In the illustrated embodiment, each of the entrainer shafts 30A, 30B and 30C is in its entrainer position wherein the register pins project beyond the lateral surface of the accumulator cylinder 4. If the shaft 30A, 30B or 30C is rotated counterclockwise, as seen in FIG. 3, they reach a release position wherein the register pins are retracted or drawn into the cylinder 4.

Figure 4:
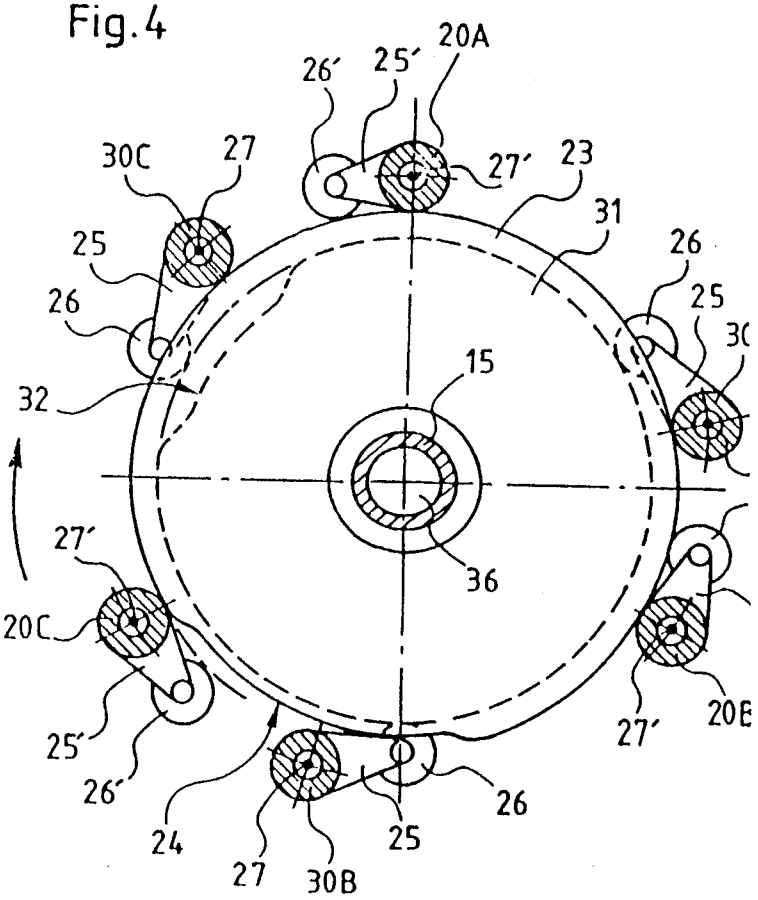
FIG. 4 is a diagrammatic cross-sectional view of FIG. 2 taken in the direction of the arrows on a plane in which the section line III—III is disposed.

A control cam 31 for controlling the entrainer shafts has a generally circular shape with a control region 32 at the circumference thereof (note FIG. 4) and is fixed to the frame 17 of the folding machine coaxially with the shaft 15. Each entrainer shaft 30A, 30B, 30C extends to the vicinity of the cam 31 and, for cooperating with the latter, carries a lever 25 with a roller 26. Disposed inside the shaft 15 is a torsion bar 27 which is coupled to the shaft 30A at an end of the torsion bar 27 carrying a lever 27. At the other end of the torsion bar 27, the latter is coupled to the flange 18A by means of an anchoring socket 28. The torsion bar is prestressed so as to apply a return torque which tends to rotate the shaft in counterclockwise direction, as seen in FIG. 3 or FIG. 4, so that the roller 26 is applied to the cam 31 with an elastic or resilient force having an amplitude sufficient for the roller 26 to remain spontaneously in continual contact with the cam 31, so that each of the shafts 30A, 30B and 30C is in the entraining position thereof when its roller is disposed opposite the circular part of the cam 31, and is in the release position when its roller is disposed opposite the control region 32 of the cam 31.

The tucker or tucking blades 12A, 12B and 12C are carried by respective shafts 20A, 20B and 20C which are rotatably mounted on the accumulator cylinder 4 in bearings 21A' and 21B', in the same manner as the register-pin shafts.

In the graphically represented configuration, each tucking-blade shaft 20A, 20B or 20C is shown in its retracted position in which the tucking blade which it carries is retracted into the accumulator cylinder 4. If any of the shafts 20A, 20B and 20C is rotated counterclockwise as seen in FIGS. 3 and 4, the respective shafts 20A, 20B, 20C reaches an insertion position in which the tucking blade which it carries is deployed, i.e., projects beyond the lateral surface of the accumulator cylinder 4.

In a similar manner as for the entrainer shafts 30A, 30B and 30C, the tucking-blade shafts 20A, 20B and 20C are controlled by a cam 23 which is generally circular in shape with a control region 24 formed on its periphery and is fixed to the frame 17 coaxially with the shaft 15. The tucking-blade shafts 20A, 20B and 20C and the cam 23 cooperate in a similar manner as do the shafts 30A, 30B and 30C and the cam 31, the means which implement this cooperation being identified by the same reference numerals with a prime added thereto.

Each of the shafts 20A, 20B and 20C is automatically in the retracted position when its roller 26' is disposed opposite the circular part of the cam 23 and in the insertion position when its roller is located opposite the control region 24.

The angular relationship of the cams 23 and 31 is such that when a tucking blade, the blade 12C, for example, is tangential to the jaw cylinder 5, the roller 26' of the tucking-blade shaft carrying it, the shaft 20C, for example, is disposed opposite the control region 32. Thus, when a tucking blade of the accumulator cylinder 4 is aligned with a jaw of the jaw cylinder 5, it not only travels out in order to hold the paper firmly in the jaw, but also the register pins preceding it are retracted into the cylinder in order to release the cop or signature to either side of the tucking blade.

Within the scope of this automatic mode of operation, each copy or signature carried by the accumulator cylinder 4 is transferred in this way to the jaw cylinder 5, which corresponds to an operation in the double production mode.

To enable it to operate in the accumulation mode, the accumulator cylinder 4 is provided with suitable means which are described hereinafter.

A respective latch 33A, 33B, 33C for each entrainer shaft 30A, 30B, 30C is fastened to the flange 18B near the respective entrainer shaft. Each of the latches is mounted parallel to the associated entrainer shaft, and, on the side towards the interior of the flange 18B, has a movable rod 34 which is retracted when the latch is not operated and deployed when the latch is operated.

To cooperate with the movable rod of the respective latch associated therewith, each entrainer shaft has a projecting lever 35 near the inside surface of the flange 18B. In the nonoperating position of the latch, the rod 34 cannot come into contact with the lever 35 of the shaft associated therewith, which therefore behaves automatically as previously described. When one of the latches goes into the operating position thereof, its rod 34 is deployed and positioned in front of the lever 35 of the shaft associated therewith if the latter is in the entraining position. As long as the rod remains deployed, no rotation of the shaft in counterclockwise direction, as seen in FIGS. 3 and 4, is possible because the rod immobilizes or blocks the lever against movement in this direction; consequently, the shaft remains in the entraining position when its roller 26 is located opposite the control region 32, such as is shown in FIGS. 3 and 4 for the shaft 30C, the rod of the latch 33C being deployed in the configuration shown in these figures.

Similarly, a respective latch 33A', 33B , 33C' with a movable rod 34' is provided for each tucking-blade shaft 20A, 20B, 20C. Each of the latter shafts has a projecting lever 35' to cooperate with the latch associated therewith in the same manner in which the entrainer shafts cooperate with their latches, respectively. FIGS. 3 and 4 show that the shaft 20C is disposed in the retracted position thereof although its roller 26' is disposed opposite the control region 24, because the rod of the latch 33C' is deployed or extends outwardly.

This entraining shaft and the tucking-blade shaft are therefore provided with a latch form-lockingly fixed to the cylinder, and nevertheless permit an operating position in which the shaft is blocked to prevent its roller from descending into the control region on the cam. In the nonoperating position thereof, there is no effect upon the shaft.

The latches can be disposed on the cylinder in many ways, depending upon given conditions.

Figure 5:
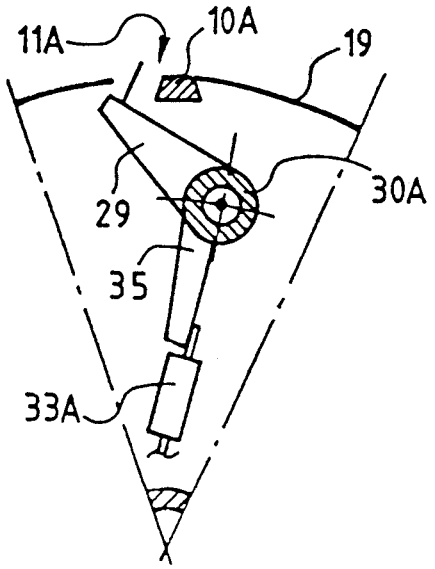
FIG. 5 is a slightly enlarged fragmentary view of FIG. 3 showing an alternative embodiment of the latches forming part of the invention.

In the embodiment shown in FIG. 5, for example, instead of being disposed axially, all of the latches are disposed radially and are fixed to the inside of the flange 18B.

In the embodiment shown in FIG. 5, for example, instead of being disposed axially, all of the latches are disposed radially and are fixed to the inside of the flange 18B.

Figure 6:
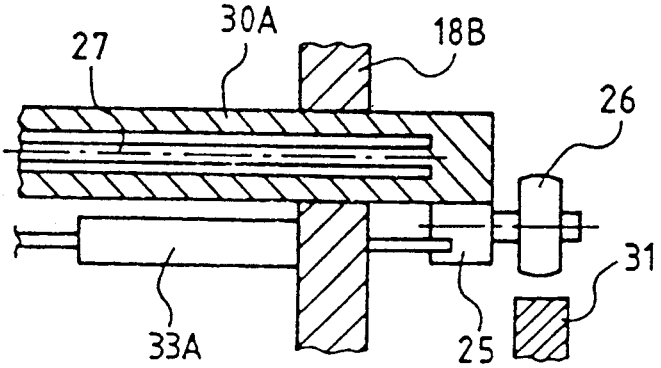
FIG. 6 is a fragmentary longitudinal sectional view of FIG. 2 taken in the direction of the arrows in a plane in which the section line VI—VI is disposed, and showing in an alternative embodiment of the accumulator cylinder.

In the embodiment shown in FIG. 6, each latch is movable axially yet its rod is movable on the outside of the flange 18B where it does not cooperate with a special lever 35 or 35', but rather with the roller support lever of the shaft associated therewith.

As before, with latches provided with moving rods, it is possible to arrange them radially and to have the rod cooperate with a simple radial hole formed in the shaft. More generally, any type of latch capable of immobilizing or blocking a shaft, and reacting to a signal, may be used.

Figure 7:
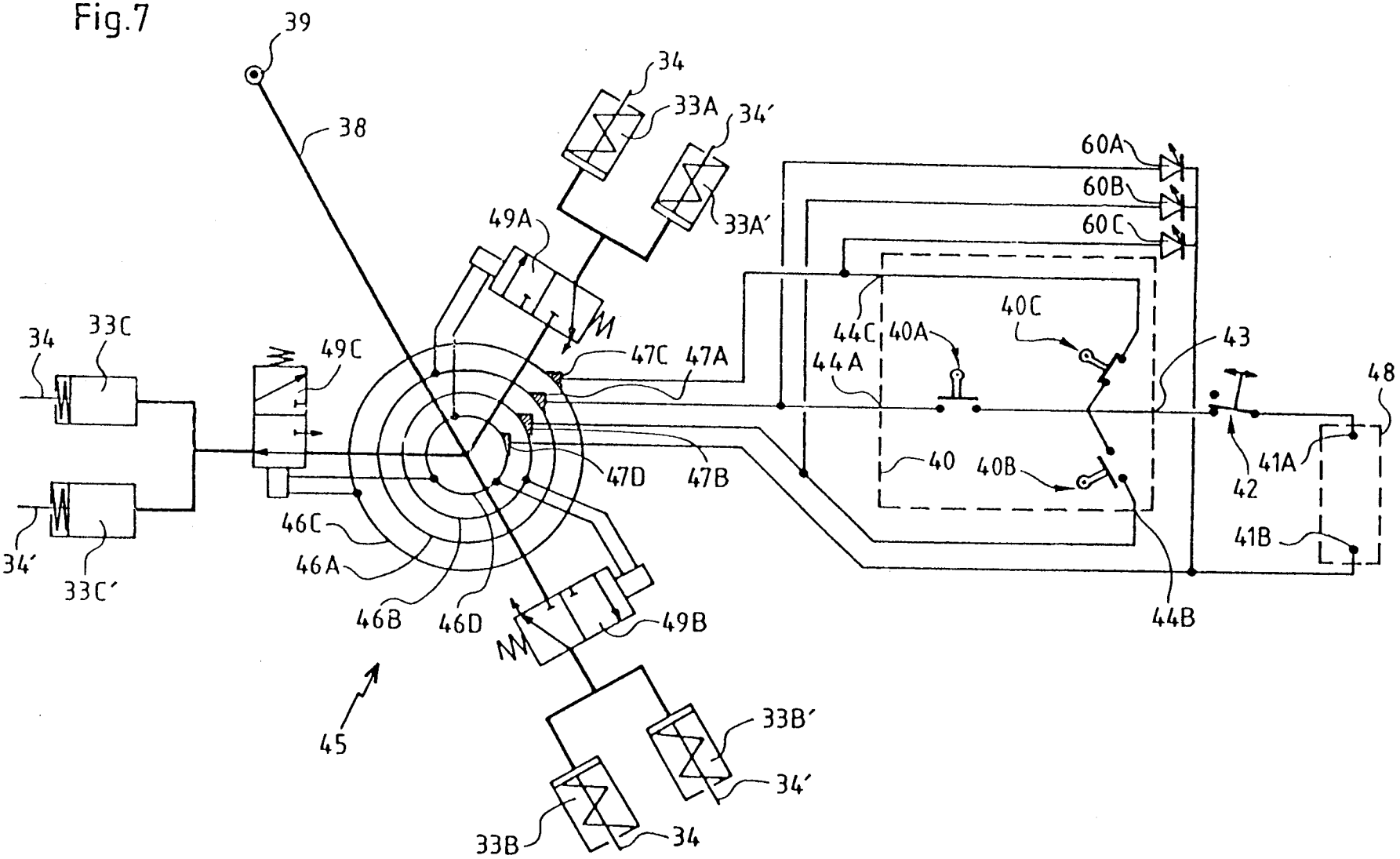
FIG. 7 is a diagrammatic view of the latch control system according to the invention.

FIG. 7 is a diagrammatic view of an overall system for controlling the latches of the accumulator cylinder 4.

The latches with movable rods used in this case are, respectively, in the form of a simply acting pneumatic or compressed-air latch which is returned by spring force to the nonoperating position when it is subjected to pressure and returns to the nonoperating position thereof when it is vented, i.e., when the pressure escapes.

To make a pressure source available on the accumulator cylinder 4, the central shaft 15 is made hollow and its interior 36 is connected to a compressed air or pneumatic pressure source 39 via a rotary seal or coupling 37 (visible on the left hand side in FIG. 2) and a line 38.

The latches of the accumulator cylinder 4 are grouped into three measuring-cell pairs, each pair thereof including the latch of an entrainer shaft and the latch of a tucking-blade shaft following the latter (form the viewpoint of a fixed observer watching the cylinder rotate), in other words 33A and 33A', 33B and 33B', 33C and 33C'; the latches in each pair are pneumatically connected to the same solenoid valve, respectively 49A, 49B, 49C. Each of the solenoid valves is connected pneumatically to the interior 36 of the shaft 15 and has an open position and a pressure venting position. In the pressure venting position, each of the latches of the associated measuring-cell pair is vented to the atmosphere and is therefore in the nonoperating position. In the open position, each of the latches is connected to the interior 36 of the shaft 15, i.e., it is under pressure and therefore in the operating position thereof.

The solenoid valves 49A, 49B and 49C (and therefore the associated pairs of latches) react to electrical signals generated by signalling means 40.

A power supply terminal 43 is provided which is connected to a terminal 41A of an electrical power supply 48 through an electrical switch 42. The signaling means 40 have been simplified by showing only three contactors 40A, 40B and 40C which selectively establish contact between the power supply terminal 43 and the respective output terminals 44A, 44B and 44C. When contact is established between one of these output terminals and the terminal 43, and the switch 42 is closed, this output terminal is connected to the electrical power supply and one can assume the presence of a signal at this output terminal; without this connection or power source, no signal can appear at this terminal.

Each output terminal of the generator 40 is connected to the solenoid valve identified with the same suffix, and each solenoid valve is also connected to the second terminal 41B of the electrical power supply 48, so that when a signal is present at one of the terminals 44A, 44B or 44C, the latches identified by a reference character with the same suffix are in the operating position, whereas if there were no signal they would be in the nonoperating position.

To provide a visual indication of the operation, and to facilitate troubleshooting, light-emitting diodes 60A, 60B and 60C are provided, respectively, having one terminal connected to the second terminal 41B of the electrical power supply 48 and the other terminal connected to the respective terminal 44A, 44B or 44C.

In this way a light-emitting diode or LED is lit when the latches which are identified by reference characters having the same suffix are in the operating position, and is off when the latches are in the nonoperating position.

To connect the solenoid valves 49A, 49B and 49C to the signalling means 40 and to the terminal 41B of the electrical contact assembly 45 is provided which is made up of four rings 46A, 46B, 46C and 46D which are form-lockingly connected to the accumulator cylinder 4 and coupled with respective fixed or firmly anchored 47A, 47B, 47C and 47D.

The brushes 47A, 47B, and 47C are respectively connected to the terminals 44A, 44B and 44C of the generator 40, and the brush 47D is connected to the second terminal 41B of the electrical power supply 48; in contrast therewith, each solenoid valve 49A, 49B, 49C is connected to a common ring 46D and to the respective ring having a reference character with the same suffix as that of the respective solenoid valve.

In a non-illustrated alternative embodiment, instead of being a pneumatic actuator, each latch is a solenoid valve with a plunger which is spring-loaded to return to the nonoperating position, the pneumatic part of the control system being replaced by its electrical equivalent.

In addition to the contactors 40A, 40B and 40C diagrammatically represented in FIG. 7, the signaling means 40 include (note FIGS. 2 and 8) a pinion 50 form-lockingly connected to the central shaft 15 of the accumulator cylinder 4, a wheel 51 mounted so as to rotate on a shaft force-lockingly connected to the frame 17 of the folding machine, the wheel 51 having twice the diameter of the pinion 50 and cooperating with the latter. Also included are a circular sector 52 form-lockingly connected to the wheel 51, a set of three sensors 53A, 53B and 53C fixed to the frame 17 and disposed opposite to the wheel 51 and offset angularly 120 from one another. Devices are also provided which, when a sensor is facing the sector 52, serve to close the respective contactor 40A, 40B or 40C having a reference character with the same suffix, which would otherwise be open.

The characteristics of the sector 52, the sensors 53A, 53B and 53C and the devices by means of which they operate on the contacts are well known and consequently need not be described in further detail.

Taking into account the branchings and connections, respectively, just described, when a measuring cell or sensor is facing the sector 52, the latch of the tucking blade and the latch of the register pins identified by a reference character with the same suffix are in the operating position and, otherwise, in the nonoperating position. Thus, in the configuration shown in FIG. 8 in which the measuring cell or sensor 53C is located opposite the sector 52, and the sensors 53A and 53B are not located thereat, the latch of the tucking blade 12C and that of the register pins 11C are in the operating position, and the others are in the nonoperating position.

The angle subtended by the sector 52 and the angular position thereof are such that if the measuring cell or sensor of a tucking blade must be disposed opposite the sector when the tucking blade is tangential to the jaw cylinder 5, the sector has begun to face the sensors, in fact, slightly before the rollers 26 and 26' on the respective associated shafts are disposed opposite the control region of their cam. In contrast therewith, the sector 52 ceases to face the sensors when the rollers have travelled beyond the control region of their cam.

When a tucking blade is consequently tangential to the jaw cylinder 5, and its measuring cell or sensor is disposed opposite the sector 52, the paper covering the tucking blade is not transferred to the jaw cylinder 5; on the other hand, the paper is transferred if the sensor or measuring cell is not located opposite the sector.

At the point at which the cylinders 4 and 5 are tangential to each other, the succession of tucking blades is 12C, 12B, 12A, and so forth, so that the succession of the corresponding sensors or measuring cells at this point is 53C, 53B, 53A, and so forth.

Figure 2:
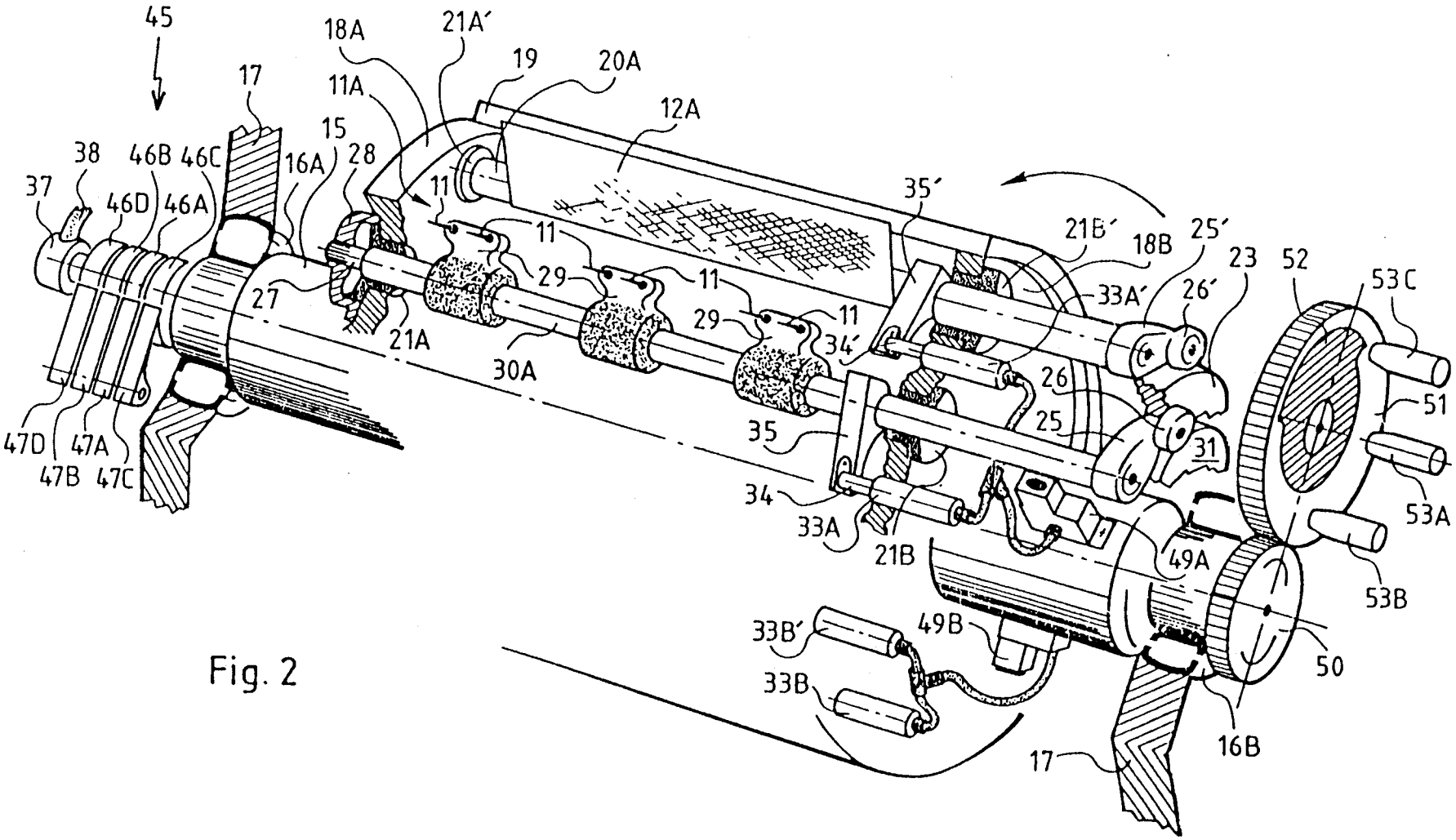
FIG. 2 is a perspective view, partly in section and partly broken away, of the accumulator cylinder of FIG. 1.
Figure 8:
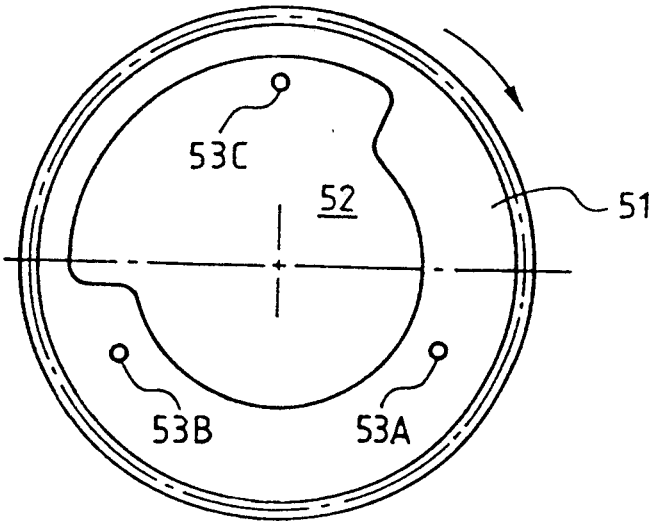
FIG. 8 is a fragmentary enlarged elevational view of FIG. 2 as seen from the right-hand side thereof and showing a rotating sector and proximity sensors which produce signals for the latches in accordance with the invention.

It is apparent from FIGS. 2 and 8, that these sensors have been positioned so that their successive appearance is in a direction opposite to the direction of rotation of the sector 52.

Moreover, in view of the ratio between the diameters of the pinion 50 and the wheel 51, the sector 52 rotates at half the speed of the accumulator cylinder 4.

Thus when a tucking blade arrives at the location of the tucking blade which precedes it, that is to say, when the accumulator cylinder 4 has rotated 1/6 of a revolution away in the reverse direction, the respective sensor and the sector are spaced from one another $1/6+\frac{1}{2}$ of a revolution, which is half of a revolution.

It follows that if the sensor of a tucking blade is disposed opposite the sector when the tucking blade is tangential to the jaw cylinder 5, the sensor of the tucking blade which succeeds it in the same position is not, and so forth, so that the paper which covers the first tucking blade is transferred, the paper which covers the next tucking blade is not transferred, and so forth, whereby the cylinder operates in the accumulation mode.

The switch 42 is used to select the operating mode of the folding machine.

In the open position, the signalling or signal producing means 40 are not supplied with power and no signal is produced, the latches are in the nonoperating position, and the entrainer shafts and the tucking blades are in automatic operation in the manner described hereinbefore. This corresponds to the double-production mode of operation.

Table I at the end of this specification shows the operating mode, indicating which copies are transferred into which jaw of the cylinder 5, the jaws being identified by their suffix and the rank or sequence of the copy or signature by a subscript, so that, for example, B3 denotes the third B copy or signature.

If, as shown, the first copy transferred is an A copy or signature and is transferred to the folding jaw 13A, then the jaw 13A and the jaw 13C always receive an A copy or signature whereas the jaws 13B and 13D always receive a B copy or signature.

The A signature, transferred to the jaw 13A, reaches the lower former fold 7B, after having been transferred by the clamp 14B'. The A signature transferred to the jaw 13C will also reach the lower former fold 7B, after being transferred by the clamp 14A'.

On the other hand, the B signatures contained in the jaws 13B and 13D, and respectively transferred by the clamps 14A and 14B, exit to the upper former fold 7A.

With the switch 42 in the closed position, the accumulator cylinder 4 operates in the accumulation mode, as already explained hereinbefore.

Table II is similar to Table I but shows the accumulation mode, the signatures which have an inclined line struck therethrough being those which are not transferred.

Signature A1 has not been transferred, signature B1 has been, signature A2 has not been, the combination formed by the signature Al retained on the previous rotation and the signature B2 which has just covered it is transferred, and accordingly the production as follows remaining stable: the jaws 13A and 13C receive nothing, while upon each contact the jaws 13B and 13D receive a set of A and B signatures in which the A signature is inside the B signature.

There are therefore signatures with double pagination, or accumulated signatures, in the jaws 13B and 13D which are then respectively transferred by the clamps 14A and 14B of the cylinder 6A to the upper former fold 7A.

Hereinafter described is an alternative embodiment of the signalling or signal production means in which, for the same configuration, by simply operating a switch, the sets of signatures are deposited onto the former fold 7B instead of the former fold 7A.

Figure 9:
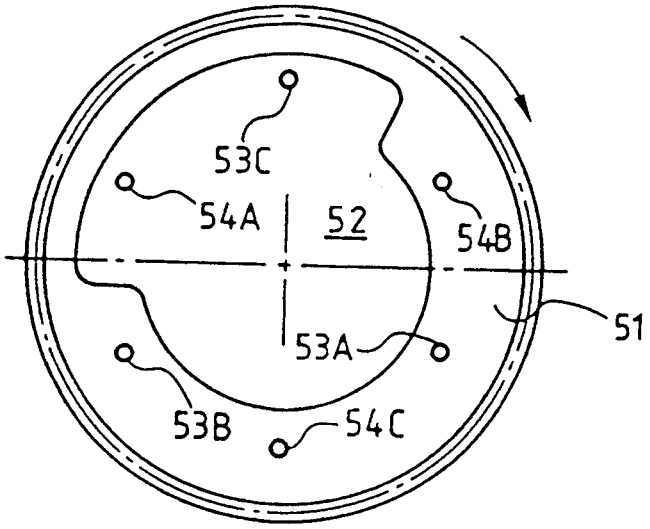
FIG. 9 is a view like that of FIG. 8 of an alternative embodiment of the invention.

In this embodiment, as shown in FIG. 9, the signalling or signal production means further include a second set of three sensors 54A, 54B and 54C offset 180° with respect to the set 53A, 53B and 53C, so that the two sensors with the same suffix are diametrically opposed, and a selector switch 55 (shown in FIG. 10) formed of six input terminals 56A, 56B, 56C, 57A, 57B, 57C, respectively, connected to sensors 53A, 53B, 53C, 54A, 54B and 54C and three output terminals 58A, 58B and 58C.

Figure 10:
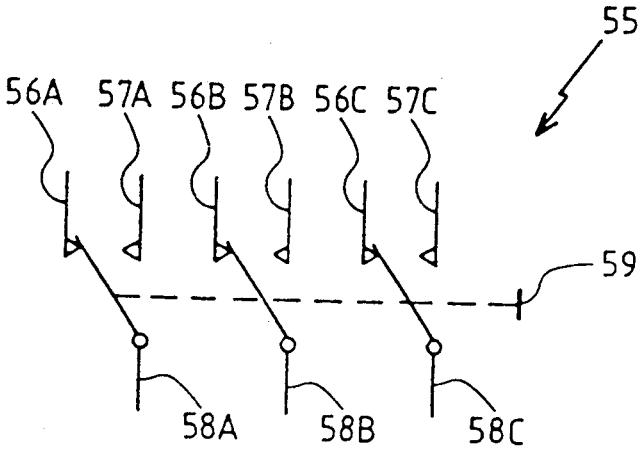
FIG. 10 is a diagrammatic and schematic view of a switch included in the embodiment of FIG. 9.

In the position shown in FIG. 10, the output terminals are respectively connected to the sensors 53A, 53B and 53C so that the cylinder operates in the accumulation mode as explained hereinbefore, i.e., in accordance with Table II. In the other position of the switch, which is obtained by moving the common control member 59 towards the right-hand side of the figure, the sensors 54A, 54B and 54C are respectively substituted for the sensors 53A, 53B and 53C, and the signals at the terminals 44A, 44B and 44C are in phase opposition, which means that the jaws 13A and 13C receive the sets of two signatures and the jaws 13B and 13D receive nothing, all of the sets of signatures being recovered by the cylinder 6B and then deposited onto the former fold 7B.

Moreover, there are B signatures which are arranged inside the A signatures, rather than the reverse thereof.

The signalling or signal production means described thus far in relation to the accumulator cylinder 4 generates a series of signals for each pair of latches which include a first latch associated with a tucking-blade shaft and a second latch associated with an entrainer shaft preceding the tucking-blade shaft, the signals produced being such that the paper which covers a first tucking blade is not transferred to the jaw cylinder, whereas, on the other hand, the paper which covers a second tucking blade following the first-mentioned tucking blade is transferred, and so forth.

Numerous variations thereof are possible and, in particular, depending upon the circumstances, it may be preferable to use a rotary sensor or measuring cell and numerical or digital means to generate these three series of signals based upon data provided by the rotary sensor.

When used with a double printed paper web the accumulator cylinder according to the invention may have five or seven tucking blades or even more blades having an odd number, rather than three, to which there is associated everything associated with each of the tucking blades in the example which have been described herein, i.e., not only what is specific to each tucking blade (inserter shaft, latch, sensor or measuring cell, if any, and the like) but also an entrainer member with everything characteristic therewith and a cutting countermember.

Figure 11:
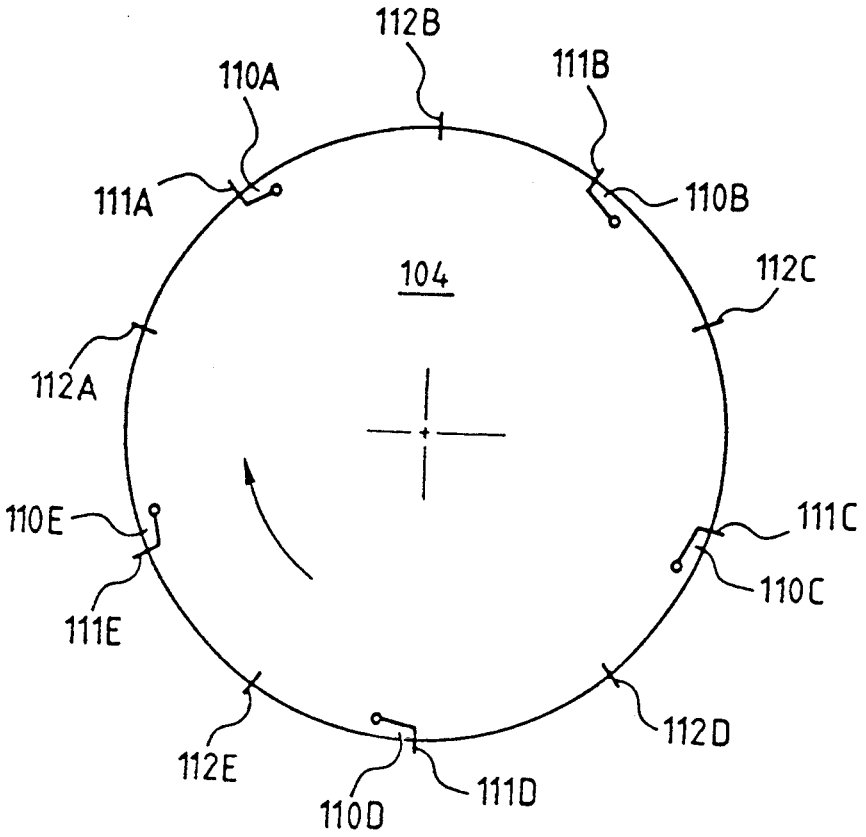
FIG. 11 is an enlarged fragmentary view of FIG. 1 showing an alternative embodiment of the accumulator cylinder in accordance with the invention wherein five tucking blades or inserter knives and associated members are provided instead of three.

Thus, the accumulator cylinder 104 shown in FIG. 11 is formed with five cutting countermembers 110A, 110B, 110C, 110D and 110E, five entrainer members 111A, 111B, 111C, 111D and 111E and five tucking blades 112A, 112B, 112C, 112D and 112E.

The system controlling the entrainer members and the tucking blades is similar to that shown in FIGS. 2 through 10, but with a succession of the fifth order instead of the third order.

In the double production mode of operation, the accumulator cylinder 104 operates in a manner similar to that of the accumulator cylinder 4, i.e., in accordance with Table I at the end of this specification.

Table III shows in a similar manner as Table II, the operation of the accumulator cylinder 104 in the accumulation mode. The A1 signature is held on the cylinder, the B1 signature is transferred, the A2 signature is held on the cylinder, the B2 signature is transferred, the A3 signature is held on the cylinder, the A1 signature held back on the previous rotation and the B3 signature which has just covered it are transferred to the jaw cylinder 5; the production is thus stable, the jaws 13A and 13C receiving nothing, whereas the jaws 13B and 13D receiving for each contact a set of signatures A and B.

The result is similar to that for the accumulator cylinder 4 and, more generally, everything which has been stated hereinabove for the accumulator cylinder with three tucking blades is applicable to accumulator cylinders with five or seven tucking blades, or even a greater odd number of tucking blades, when used with a double-printed paper web.

As an alternative, the accumulation cylinder with five tucking blades can operate not only with a double-printed paper web but also with a triple-printed paper web, i.e., a paper web printed with a regular succession of A, B and C signatures, the control device with which the cylinder in this case is provided being adapted to cause the cylinder to operate in the multiple (double or triple) production mode and in the accumulation by twos or accumulation by threes mode, respectively.

Table IV shows the operation of the accumulation cylinder in the last-mentioned embodiment, in the triple production mode, in other words, when the switch corresponding to the switch 42 is open.

The folding jaw 13A receives an A signature, then a B signature, then a C signature, and so forth, and relative to the jaw 13A, there is an offset of one signature for the jaw 13B, two signatures for the jaw 13C and three signatures for the jaw 13D.

Figure 12:
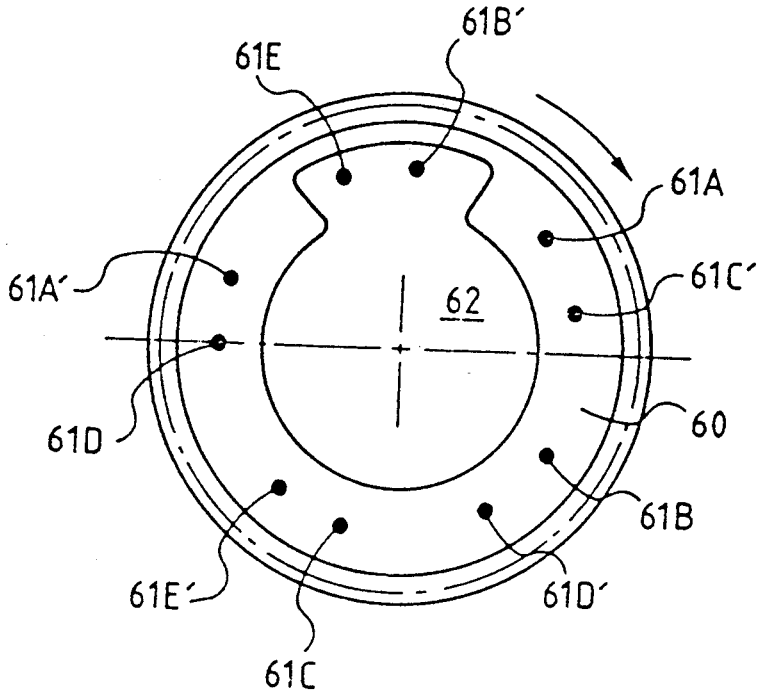
FIG. 12 is also an enlarged fragmentary view of FIG. 1 showing a sector and proximity detectors enabling an accumulation mode by threes.

With regard to the accumulation mode, the signalling or signal production means are similar to those shown in FIGS. 2, 7 and 8, but of the fifth order rather than the third order, however, they include in addition to the pinion, the wheel and the sector corresponding to the members 50, 51 and 52, a second pinion, a second wheel, a second sector and a second set of sensors, these various additional members being represented in FIG. 12.

The wheel 60 and the non-illustrated pinion have such diameters that the sector rotates at one third the speed of the cylinder. For each tucking blade, there is provided a respective pair of fixed sensors 61A and 61A', 61B and 61B', 61C and 61C', 61D and 61D', and 61E and 61E'. The sensors of each pair (61A and 61A', for example) are offset 240° while the pairs are equiangularly and regularly spaced with respect to the course of the sector 62, which means that they are mutually offset 72° in the example shown where there are five tucking blades.

Figure 13:
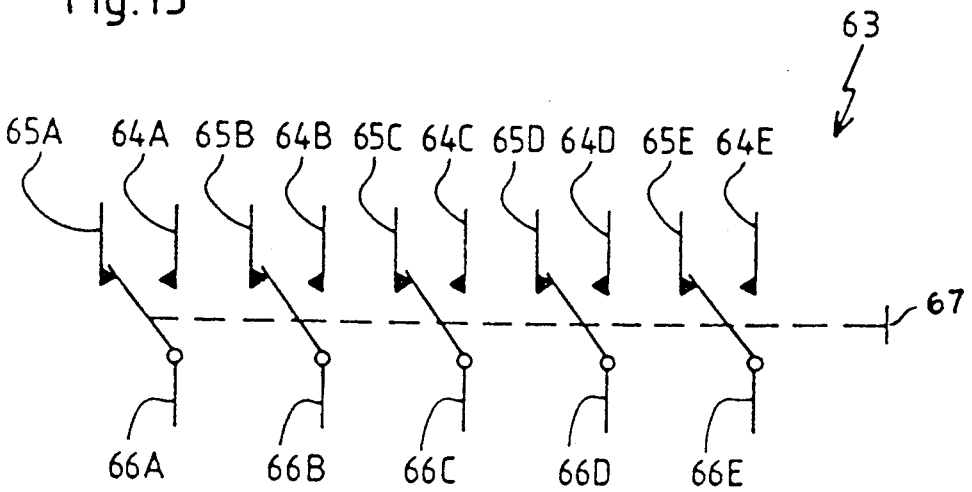
FIG. 13 is a diagrammatic and schematic view of a switch enabling the cylinder of FIG. 11 to operate in accumulation-by-twos mode or accumulation-by-threes mode.

An accumulation-quantity switch 63 shown in FIG. 13 has ten input terminals 64A through 64E and 65A through 65E and five output terminals 66A through 66E. The terminals 64A through 64E are connected to the aforedescribed sensors used for the accumulation by the respective twos mode. The terminals 65A through 65E are, respectively, connected to the two sensors of the respective sensor pairs, so that the terminal 65A, for example, is connected to the sensors 61A and 61A'. The output terminals 66A through 66E are connected to the signalling or signal production means corresponding to the means 40.

In the position shown, these means 40 are therefore connected to the sensors shown in FIG. 12 so that each tucking blade is deployed only when one of the two sensors of the pair identified by reference numerals with the same suffix is facing the sector 62. Thus the tucking blade 112A, for example, is not deployed when the sensor 61A is facing the sector 62, nor when this applies with respect to the sensor 61A'.

It is apparent that the means shown in FIG. 12 enable the accumulation by the threes mode.

The switch 63 permits a selection of the accumulation quantity. In the position shown, the accumulation by the threes mode is selected, whereas in the other position of the switch, which is arrived at by moving the common control member 67 to the right-hand side as shown in the figure, the accumulation by twos mode is selected.

When working in the accumulation mode, in addition to operating the switch corresponding to the switch 42 in FIG. 7, the accumulation quantity switch is set to the accumulation-by-twos position with a double printed paper web, and in the accumulation by threes position with a triple printed paper web.

The accumulation-by-twos operating mode has been explained hereinbefore with reference to Table III.

Table V represents the operation in the accumulation-by-threes mode. The A1 and, then, the B1 signatures are held, the C1 signature is transferred to the jaw cylinder, the A2 and, then, the B2 signature are held, the A1 signature held on the previous rotation and the C2 signature which has just covered it are transferred to the jaw cylinder 5, the B1 signature held on the previous rotation and the A3 signature which has just covered it are held, the B3 signature is held, the A2 signature held on the previous rotation and the C3 signature which has just covered it are transferred to the jaw cylinder 5, the B2 signature held on the previous rotation and the A4 signature which has just covered it are held, the B4 signature is held, the set of three signatures formed by the B1 signature held two rotations back and then covered on the previous rotation with the A3 signature which has itself just been covered with the C4 signature is transferred, whereby the operation remains stable as follows: one of respectively three jaws on the cylinder 5 receives a group of three signatures, while the other jaws do not receive anything.

In the example shown, the C signature is covered by the A signature which is itself covered by the B signature, but if the printed paper web is offset by one signature to the right-hand side relative to Table V, then the signatures are received in the same order B, C and A, or if offset by two copies, in the succession A, B and C.

In an alternative embodiment, the jaw cylinder 5 is replaced by a cylinder with six jaws and, in this case, it is always the same two jaws which grip the sets of three signatures.

In the just-described embodiment of the signalling or signal production means for an accumulation cylinder with five tucking blades enabling it to operate in the accumulation-by-twos or the accumulation-by-threes mode, the signalling or signal production means generate a series of signals for each pair of latches which includes a first latch associated with a tucking-blade shaft and a second latch associated with an entrainer shaft preceding the tucking-blade shaft, and includes an accumulation quantity switch according to the position of which the signals which are produced are adapted so that either the paper which covers a first tucking-blade is not transferred to the jaw cylinder, the paper which covers a second tucking blade, which follows the first tucking blade, is transferred, and so forth; or the paper which covers a first tucking blade is not transferred to the jaw cylinder, the paper which covers a second tucking blade following the first tucking blade is not transferred, the paper which covers a third tucking blade which follows the second tucking blade is transferred, and so forth.

Numerous variations of the invention are possible and, in particular, depending upon the circumstances, it may be preferable to use a rotary sensor and numerical or digital means to generate the five series of signals from data supplied by the rotary sensor.

It should be noted, especially, that it is possible to transpose everything that has been stated herein with respect to the cylinder 104 to a cylinder with seven tucking blades and, in particular, the embodiment in which the accumulation-by-twos and the accumulation-by-threes modes are provided for.

Furthermore, it is possible, in another embodiment of the accumulation cylinder 104 to provide, for signalling or producing the signals addressed to the latches, only the means explained with reference to FIG. 12, if operation in the accumulation-by-threes mode only is required or desired.

In this case, use may also be made of accumulator cylinders with two, four or seven tucking blades, by providing respectively two, four or seven equi-angularly and regularly distributed pairs of sensors, the sensors in each pair being offset 240° from one another.

Accumulator cylinders in accordance with the invention are also usable in other types of folding machines than those described herein, in particular, folding machines of the so-called drum or hypocycloidal type, as well as folding machines with variable cuts, jaw folding machines without register pins but with clamps of the type used for photogravure printing, and the like.

TABLE I

| Jaws 13 | A | B | C | D | A | B | C | D | A | B | C | D |
|---|---|---|---|---|---|---|---|---|---|---|---|---|
| Copies transferred | $A_1$ | $B_1$ | $A_2$ | $B_2$ | $A_3$ | $B_3$ | $A_4$ | $B_4$ | $A_5$ | $B_5$ | $A_6$ | $B_6$ |

TABLE II

| Jaws 13 | A | B | C | D | A | B | C | D | A | B | C | D |
|---|---|---|---|---|---|---|---|---|---|---|---|---|
| Copies transferred | $A_1$ | $B_1$ | $A_2$ | $A_1 + B_2$ | $A_3$ | $A_2 + B_3$ | $A_4$ | $A_3 + B_4$ | $A_5$ | $A_4 + B_5$ | $A_6$ | $A_5 + B_6$ |

TABLE III

| Jaws 13 | A | B | C | D | A | B | C | D | A | B | C | D |
|---|---|---|---|---|---|---|---|---|---|---|---|---|
| Copies transferred | $A_1$ | $B_1$ | $A_2$ | $B_2$ | $A_3$ | $A_1 + B_3$ | $A_4$ | $A_2 + B_4$ | $A_5$ | $A_3 + B_5$ | $A_6$ | $A_4 + B_6$ |

TABLE IV

| Jaws 13 | A | B | C | D | A | B | C | D | A | B | C | D | A | B | C | D |
|---|---|---|---|---|---|---|---|---|---|---|---|---|---|---|---|---|
| Copies transferred | $A_1$ | $B_1$ | $C_1$ | $A_2$ | $B_2$ | $C_2$ | $A_3$ | $B_3$ | $C_3$ | $A_4$ | $B_4$ | $C_4$ | $A_5$ | $B_5$ | $C_5$ | $A_6$ |

TABLE V

| Jaws 13 | A | B | C | D | A | B | C | D | A | B | C | D | A | B | C | D |
|---|---|---|---|---|---|---|---|---|---|---|---|---|---|---|---|---|
| Copies transferred | $A_1$ | $B_1$ | $C_1$ | $A_2$ | $B_2$ | $A_1 + C_2$ | $B_1 + A_3$ | $B_3$ | $A_2 + C_3$ | $B_2 + A_4$ | $B_4$ | $B_1 + A_3 + C_4$ | $B_3 + A_5$ | $B_5$ | $B_2 + A_4 + C_5$ | $B_4 + A_6$ |

I claim:

1. Accumulator cylinder assembly for a folding machine of a printing press having tucking-blades respectively associated with entrainer members and cutting countermembers, and a device for controlling the tucking-blades and the entrainer members including, for each tucking-blade, a tucking-blade shaft having an insertion position in which the respective tucking-blade is deployed in order to insert paper covering the respective tucking-blade into a jaw of a jaw cylinder cooperating with the accumulator cylinder, and a retracted position in which the tucking-blade is retracted; a fixed tucking-blade shaft control cam having a control region on a periphery thereof, each tucking-blade shaft having a lever carrying a roller resiliently held against the cam, the tucking-blade shaft being in the insertion position when its roller is in the control region, and being in the retracted position when the roller is not in the control region, the cam being disposed so that its control region is located opposite the roller of the tucking-blade shaft when the tucking-blade associated with the shaft is aligned with the respective jaw of the jaw cylinder; for each entrainer member, an entrainer shaft having an entraining position in which the paper is firmly held on the accumulator cylinder, and a release position in which the paper is released; a fixed entrainer shaft control cam having a control region on a periphery thereof, each entrainer shaft having a lever carrying a roller held resiliently against said cam, each entrainer shaft being in a release position when its roller is in the control region of the entrainer shaft control cam and in the entraining position when its roller is not therein, the cam being disposed so that its control region is located opposite the roller of the entrainer shaft when a tucking blade preceding the respective entrainer member associated with the entrainer shaft is located opposite the respective jaw of the jaw cylinder; the control device further comprising:

for each entrainer shaft and each tucking-blade shaft, a latch fixed to the accumulator cylinder and having an operating position in which the latch blocks the shaft to prevent its roller from being affected by the respective control region of the respective cam thereof and a non-operating position in which the latch does not act on the shaft; latch-signal production means for generating at least one series of periodic signals according to the angular position of the accumulator cylinder, in order to cause it to operate in an accumulation mode; means for enabling said latches to respond to said signals wherein each latch assumes said operating position thereof when a signal is addressed to it, and said non-operating position thereof when no signal is addressed to it; and means for selecting the operating mode of the cylinder wherein corresponding signals are fed to said latches.

2. Cylinder assembly according to claim 1, wherein said selecting means include an electrical switch disposed between said signal production means and an electrical power supply for supplying power thereto.

3. Cylinder assembly according to claim 1, wherein said means for enabling said latches to respond to said signals include a rotary electrical contact having, for each series of signals generated by said signal production means, a ring fastened to the accumulator cylinder and connected to each latch to which the series of signals is addressed, and a fixed brush connected to the signal production means.

4. Cylinder assembly according to claim 3, wherein the accumulator assembly has a hollow central shaft, the interior of which is connected to a pneumatic pressure supply through a rotary seal, each of said latches is a pneumatic latch, and said means for enabling said latches to respond to said signals include at least one solenoid valve secured to the accumulator cylinder, connected electrically to said ring of said rotary contact and connected pneumatically to at least one latch and to said interior of said hollow central shaft, said solenoid valve having means for venting the latch in the absence of any signal and, in the presence of a signal, for connecting the latch to said interior of said hollow shaft.

5. Cylinder assembly according to claim 1, wherein each of said latches has a movable rod which is deployed in said operating position and retracted in said non-operating position.

6. Cylinder assembly according to claim 5, wherein each of said entrainer shafts and tucking-blade shafts has a projecting lever extending therefrom and engageable by a respective latch.

7. Cylinder assembly according to claim 5, wherein each of said latches is a single-acting actuator spring-loaded into said non-operating position.

8. Cylinder assembly according to claim 5, wherein each of said latches is a solenoid valve having a plunger spring-loaded into said non-operating position.

9. Cylinder assembly according to claim 1, wherein each of said latches is mounted on a flange of the accumulator cylinder near the respective shaft associated with each latch.

10. Cylinder assembly according to claim 1 including an odd number of said tucking blades at least equal to three, the control device having means for actuating the accumulator cylinder to operate with double printed paper selectively in a double production mode and in an accumulation-by-twos mode.

11. Cylinder assembly according to claim 10, wherein said signal production means are capable of generating a series of signals for respective pairs of latches, said pairs including a first latch associated with a tucking-blade shaft and a second latch associated with an entrainer shaft preceding said tucking-blade shaft, the signals produced being such that paper covering a first tucking-blade is not transferred to the jaw cylinder, and paper covering a second tucking-blade following said first tucking-blade is transferred, and so forth.

12. Cylinder assembly according to claim 11, wherein said signal production means comprise a sector rotatable at half the speed of the accumulator cylinder, respective fixed sensors for said tucking-blade, said sensors being equi-angularly and regularly distributed opposite a travel path of said sector, and means for generating a series of signals for each of said sensors, a signal being generated when a sensor is disposed opposite said sector and not generated otherwise.

13. Cylinder assembly according to claim 12, wherein said signal production means further comprise a second fixed sensor for each of said tucking-blades, said second sensor being offset 180° relative to the first-mentioned sensor, and a switch for selecting the signals generated by said first sensors or by said second sensors.

14. Cylinder assembly according to claim 1, wherein the control device is adapted to cause the accumulator cylinder to operate with triple printed paper in a triple production mode or in an accumulation-by-threes mode, the accumulator cylinder having a suitable number of tucking-blades selected from the group consisting of two, four, five and seven tucking-blades.

15. Cylinder assembly according to claim 14, wherein said signal production means are capable of generating a series of signals for respective pairs of latches comprising a first latch associated with a tucking-blade shaft and a second latch associated with an entrainer shaft preceding said tucking-blade shaft, the signals produced being such that paper covering a first tucking-blade is not transferred to the jaw cylinder, paper covering a second tucking-blade following said first tucking-blade is not transferred, paper covering a third tucking-blade following said second tucking-blade is transferred, and so forth.

16. Cylinder assembly according to claim 15, wherein said signal production means comprise a sector rotatable at one-third the speed of the accumulator cylinder; respective pairs of fixed sensors for each tucking-blade, the sensors of each pair being mutually spaced 240° apart said pairs of sensors being equi-angularly and regularly distributed facing a path of the sector; and means for generating a series of signals for each sensor, wherein a signal is generated when a sensor is facing the cylinder and not generated otherwise.

17. Cylinder assembly according to claim 1, wherein the control device enables the accumulator cylinder to operate with double printed or triple printed paper selectively in a multiple production mode, in an accumulation-by-twos mode and in an accumulation-by-threes mode, the accumulator cylinder comprising a number of tucking-blades selected from the group consisting of five and seven tucking-blades.

18. Cylinder assembly according to claim 17, wherein said signal production means are affective for generating a series of signals for respective pairs of latches, each pair comprising a first latch associated with a tucking-blade shaft and a second latch associated with an entrainer shaft preceding said tucking-blade shaft, and including an accumulation quantity switch having a selected position according to which the signals produced selectively cause:

paper covering a first tucking-blade not to be transferred to the jaw cylinder, paper covering a second tucking-blade following the first tucking-blade to be transferred, and so forth; and paper covering a first tucking-blade not to be transferred to the jaw cylinder, paper covering a second tucking-blade following the first tucking-blade also not to be transferred, paper covering a third tucking-blade following the second tucking-blade to be transferred, and so forth.

19. Cylinder assembly according to claim 18, wherein said signal production means comprise: a first sector rotating at half the speed of the accumulator cylinder and a first fixed sensor for each tucking-blade, said sensors being equi-angularly and regularly facing a path of said first sector; a second sector rotating at one third the speed of the accumulator cylinder and a pair of fixed second sensors for each tucking-blade, the sensors of each pair being spaced apart 240°, said pairs of second sensors being equi-angularly and regularly distributed facing a path of said second sector.

20. Cylinder assembly according to claim 19 including means for generating a series of signals selectively for said first sensors and for said second sensors, respectively, according to the position of said accumulation quantity switch, a signal being generated when a sensor is facing its sector and not generated otherwise.

* * * * *